United States Patent [19]

Casdas

[11] 4,377,452

[45] Mar. 22, 1983

[54] PROCESS AND APPARATUS FOR CONTROLLING THE SUPPLY OF ALUMINA TO A CELL FOR THE PRODUCTION OF ALUMINUM BY ELECTROLYSIS

[75] Inventor: Spyridon Casdas, Paralia-Distomon, Greece

[73] Assignee: Aluminium de Grece, Athens, Greece

[21] Appl. No.: 267,597

[22] Filed: May 27, 1981

[30] Foreign Application Priority Data

Jun. 6, 1980 [FR] France ..... 80 13029

[51] Int. Cl.[3] ..... C25C 3/06

[52] U.S. Cl. ..... 204/67; 204/245

[58] Field of Search ..... 204/67, 245

[56] References Cited

U.S. PATENT DOCUMENTS

| | | | |
|---|---|---|---|
| 3,888,747 | 6/1975 | Murphy | 204/67 |
| 4,045,308 | 8/1977 | White et al. | 204/67 |
| 4,098,651 | 7/1978 | Alder | 204/67 |

*Primary Examiner*—Howard S. Williams

*Attorney, Agent, or Firm*—Dennison, Meserole, Pollack & Scheiner

[57] ABSTRACT

A process and an apparatus is disclosed for controlling the supply of alumina of a cell for the production of aluminum by electrolysis using the Hall-Heroult process wherein each alumina supply orifice of the cell comprises a movable plunger which is electrically insulated from the superstructure of the cell and of which at least the end is electrically conducting and a means for measuring the potential between the end of the movable plunger and a point of the cell which is taken as reference potential. The plunger is moved with an alternating, substantially vertical, upward and downward movement and in each downward movement means detects whether the plunger has come into contact with molten electrolyte or with solidified electrolyte.

In the first case, when molten electrolyte is detected the plunger is raised while in the second case when solidified electrolyte is detected the electrical power supplied to the cell is increased in order to remelt the solidified electrolyte.

9 Claims, 3 Drawing Figures

PROCESS AND APPARATUS FOR CONTROLLING THE SUPPLY OF ALUMINA TO A CELL FOR THE PRODUCTION OF ALUMINUM BY ELECTROLYSIS

BACKGROUND OF THE INVENTION

The present invention concerns a process and an apparatus for controlling the supply of alumina to a cell for the production of aluminum by electrolysis using the Hall-Heroult process.

Supply means are known for supplying alumina to an electrolytic cell for producing alumina. They are described in particular in French Pat. Nos. 1,245,598; 1,526,766; 2,036,896; 2,099,343; and 2,264,098 which correspond to U.S. Pat. Nos. 3,216,918; 3,372,106; 3,679,555; 3,681,229; and 3,901,787, respectively; and in additional U.S. Pat. Nos. 3,400,062 and 3,681,229.

The apparatuses which are normally used permit transportation of the alumina to one or more supply points per cell; the alumina is poured on to the crust which is formed at the surface of the electrolyte and it is introduced into the electrolyte by blows applied by a plunger which periodically moves down and breaks the crust or keeps the hole open, in which case the alumina is poured directly into the molten electrolyte.

In general, the downward movement of the plunger is timed. The plunger travel is normally of fixed length and is determined by the mechanical system which provides for the vertical movement of the plunger.

Such an arrangement suffers from disadvantages. Depending on the hardness of the crust and the level of the free surface of the electrolyte, which may vary by several centimeters, there is a double danger; if the duration of the downward movement is too short and/or the travel of the plunger is insufficient, the crust is not broken and the alumina cannot pass into the electrolyte. If the duration of the downward movement is too long and/or the travel of the plunger is excessive, a part of the plunger will be immersed in the molten electrolyte for a certain period of time.

This results in a crust being formed on the surface of the plunger, and that crust may increase in size in the following operations and gives rise to operational problems and causes progressive wear of the plunger.

Another problem which arises is that of local cooling of the electrolyte at the supply point. It frequently happens that when one of the anodes which is adjacent the supply orifice has just been changed and has not reached its condition of thermal equilibrium, the electrolyte solidifies completely at the supply point. The alumina which is poured out is not introduced into the bath and it further accentuates local cooling of the electrolyte.

In such a case, it would be desirable to stop the supply of alumina at that point and possibly to intensify the supply to the other points if any. However, that is generally not possible due to the lack of any system for automatically detecting this defect.

An object of the present invention is to make it possible on the one hand automatically to adjust the travel of the plunger to the level of the surface of the molten electrolyte and on the other hand to detect local solidification of the electrolyte at the respective supply point in question.

SUMMARY OF THE INVENTION

A first aspect of the invention is a process for controlling the supply of alumina to a cell for the production of aluminum by electrolysis of alumina dissolved in molten cryolite, the supply being provided by any known arrangement for storage, measurement and transfer of alumina to at least one orifice which is held open in the crust which is formed at the surface of the electrolyte and into which a movable plunger can penetrate, characterized in that the plunger is moved with a substantially vertical alternating upward and downward movement and that, in each downward movement, there is detection as to whether the plunger has come into contact with molten electrolyte or with solidified electrolyte.

Detection of contact between the plunger and the electrolyte is effected by measuring the electrical voltage between the plunger and a point on the cell which is taken as reference potential, that point preferably being the negative conductor of the cell.

In addition, the plunger is electrically insulated relative to the superstructure of the cell to which it is fixed.

In the rest position, the plunger is at the potential of the negative bar or another point of the vessel which serves as electrical potential reference, by way of an electrical resistance means of suitable value.

The appearance at the plunger of the potential of the molten electrolyte upon first contact between the two elements serves as information for raising the plunger.

If, at the end of a predetermined time of downward plunger movement, there has been no detection in respect of electrical contact between the plunger and the electrolyte, the automatic arrangement gives at least one of the following commands: raising the plunger, stopping the supply of alumina at that point, increasing the electrical power of the cell and possibly increasing the rate of supply to the other orifices of the cell.

Another aspect of the same invention is an apparatus for carrying out the process for controlling the supply of alumina, comprising, at each supply orifice, a movable plunger which is electrically insulated from the superstructure of the cell and at least the end of which is electrically conducting, and a means for measuring the potential between the end of the movable plunger and a point of the cell which is taken as reference potential. It further comprises a resistance means for setting the movable plunger to the electrical reference potential.

It also comprises a means for producing at least one of the following commands, based on measurement of the potential of the plunger: raising the plunger, stopping the supply of alumina to an orifice, increasing the supply of alumina to the other orifices, increasing the electrical power supplied to the cell, and maintaining the rate of supply of alumina.

The manner of performing the invention is described with reference to FIGS. 1 to 3.

DETAILED DESCRIPTION OF THE INVENTION

Figure 1:
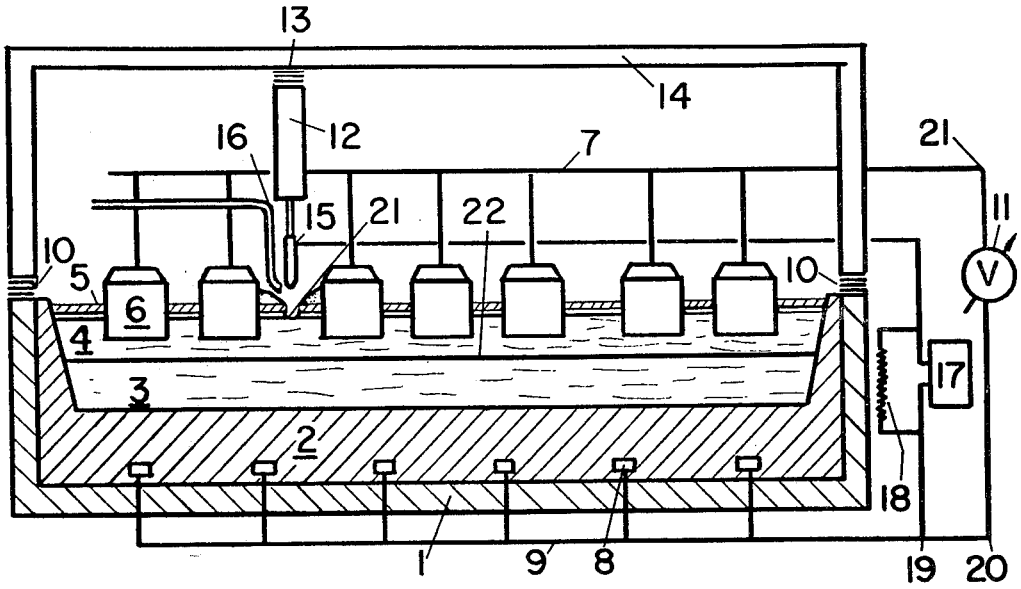
FIG. 1 shows a view in cross-section of an electrolytic cell for producing aluminum by the Hall-Heroult process.

The cell which is of the prebaked anode type comprises an insulating casing 1, a carbon lining 2 which is the cathode of the cell, a bath 3 of molten aluminum, a bath 4 of molten electrolyte above which a crust 5 is formed by solidification of electrolyte, prebaked carbon anodes 6 which are immersed in the electrolyte, one or more bars 7 which are referred to as positive, comprising aluminum, for distributing the electrical current to the anodes, bars 8 which are referred to as cathodic bars, comprising iron, which are sealed into the cathode 2 and provide for the flow of electrical current from the cathode, one or more bars 9 which are referred to as negative bars and which collect the current from the cathodic bars 8, a superstructure 14 where there are fixed the mechanisms for adjusting the position of the anodes 6 and other devices for adjusting, supplying, controlling and collecting gases and dust material emitted by the cell, in accordance with the present state of the art, and electrical insulating means 10 between the superstructure and the cathode of the vessel by virtue of the fact that the superstructure is at the same electrical potential as the anodes.

The mechanical connection between the superstructure 10 and the anodes 6 is not shown for the sake of simplicity of the drawing.

In the case of cells of the point supply type, the cell has one or more plungers 12 comprising a mechanism for vertical movement thereof, for periodically breaking the crust 5 at the point of supply in order that the alumina which is brought to the supply point by means of a conduit 16 can penetrate into the molten electrolyte 4.

The alumina storage, measurement and transfer apparatus is not shown. This apparatus may be fixed to the superstructure 14 or to the outside of the cell, in known manner. Each plunger 12 is fixed on the superstructure 14 by means of electrical insulation 13. An electrical cable 15 which is connected to the plunger and a second cable 19 which is connected to the negative bar 9 make it possible to provide at the input of an automatic control box 17 the voltage between the plunger and the negative bar. An electrical resistor 18 connected in parallel with the input of the automatic control arrangement makes it possible to adjust the degree of sensitivity of the system. The value thereof is not critical and may be for example of the order of about a hundred ohms. The voltage between the positive bar and the negative bar is measured by means of a voltmeter 11 and controlled by a conventional system which is not shown and which is not part of the present invention.

Under normal cell operating conditions, the voltage between the positive bar 7 and the negative bar 9 is about 4 volts, the electrical power being supplied by a rectified current source which is not shown in the drawings.

The electrical potential of the point 21 at the free surface of the molten electrolyte, the potential of the negative bar being considered as the reference potential, is of the order of 3.8 volts.

The potential of the electrolyte at point 22 which is at the surface of the bath of molten aluminum is of the order of 0.3 volt.

The potential is of intermediate values, between points 21 and 22.

In the raised rest position, the plunger is at the potential of the negative bar, by virtue of the resistance means 18. The voltage at the input of the automatic control box 17 is zero.

It will be appreciated that using the negative bar as the reference potential is an arbitrary choice and it would be possible to use another point of the cell as the reference.

Figure 2:
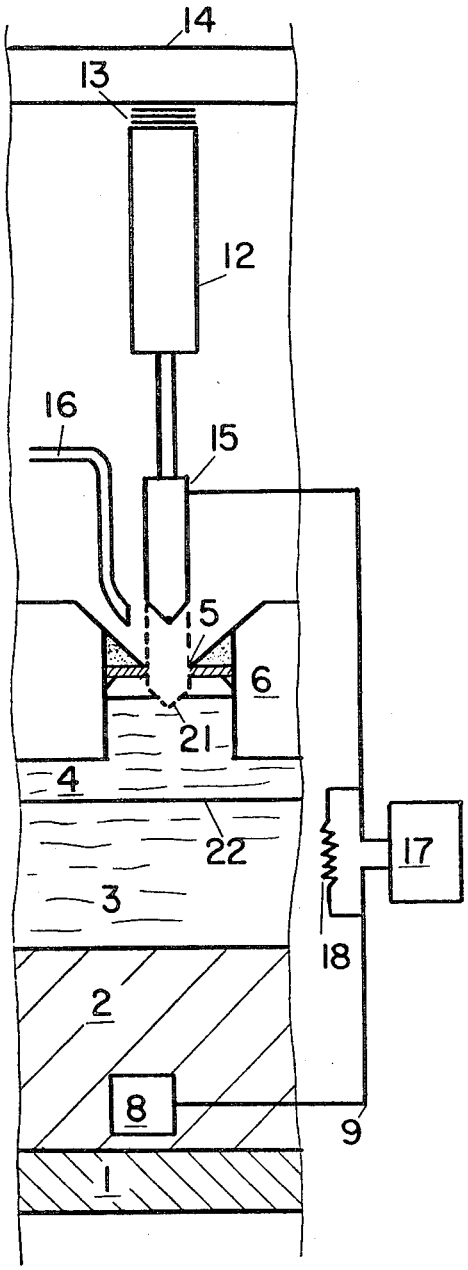
FIGS. 2 and 3 show the mode of operation of the plunger when the electrolyte is molten (FIG. 2) or solidified (FIG. 3) at the point at which alumina is introduced.

The method for detecting contact between the plunger and the liquid electrolyte is based on the fact that, when the plunger moves downwardly it assumes the potential of the electrolyte as soon as it comes into contact with the molten electrolyte at point 21, as indicated in FIG. 2. In this case, the voltage at the input of the box 17 goes from 0 volt to 3.8 volts approximately. This change is converted into a signal and permits the automatic control arrangement to give the order to raise the plunger. The travel of the plunger is therefore automatically adjusted in dependence on the level of the surface of the molten electrolyte, point 21, which may vary by several centimeters depending on the height of the bath of molten aluminum and the molten electrolyte, which vary in the course of the electrolysis process.

Contact between the plunger and the crust 5 does not have any effect of the plunger potential as the solidified electrolyte, which forms the crust, is an insulating material and has a much higher resistance than the resistance means 18 which electrically connects the plunger to the negative bar 8.

Figure 3:
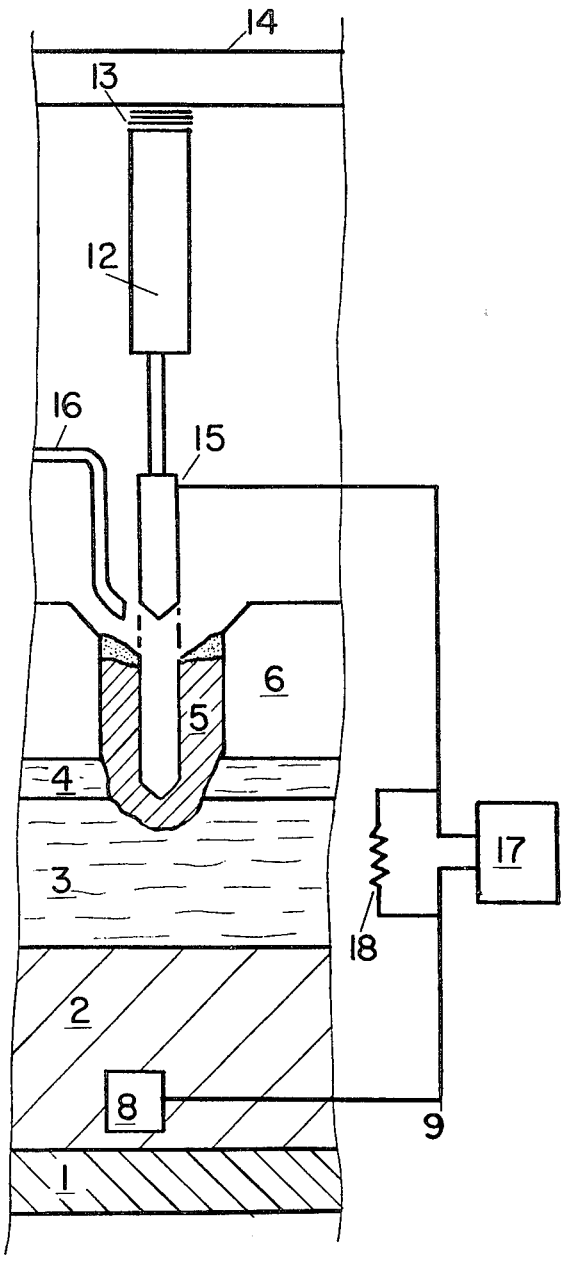

Besides automatic adjustment of the travel of the plunger, which makes it possible to avoid immersing the plunger in the molten electrolyte while ensuring that the alumina effectively passes into the electrolyte, the process of this invention makes it possible automatically to detect any solidification of the electrolyte at the supply point. This situation is shown in FIG. 3.

The plunger moves downwardly and reaches the end of the travel movement which it is possible for it to perform from the mechanical point of view; it remains at that low point for the period of time which is predetermined by the automatic control arrangement. The voltage at the input of the automatic control box is maintained at zero because the solidified electrolyte is not electrically conducting.

Expiration of the predetermined period of time for downward movement of the plunger serves as a signal for raising the plunger and for recording, in the automatic cell regulating arrangement, that the electrolyte is in a solidified condition at that supply point.

This information is used by the program of the automatic control arrangement for stopping the supply of alumina to that point, increasing the rate of supply at the other points of the cell, if any, and increasing the electrical power supplied to the cell in order to remelt the solidified electrolyte.

Therefore, using the present invention ensures total security for the supply device and perfect regularity in regard to the addition of alumina to the electrolysis cell, and therefore makes it possible to use high-precision alumina distributing and metering means, and to maintain the degree of concentration of alumina in the electrolyte at a substantially constant value.

I claim:

1. In a process for controlling the supply of alumina to a cell for the production of aluminum by electrolysis of alumina dissolved in molten cryolite electrolyte, including providing storage, measurement and transfer of alumina to at least one alumina supply orifice which is held open in the crust which is formed at the surface of the electrolyte and into which a movable plunger can penetrate, and wherein the plunger is moved with a substantially vertical alternating upward and downward movement, the improvement comprising in each downward movement the detecting whether the plunger has come into contact with molten electrolyte or with solidified electrolyte, said detection being effected by measuring the electrical voltage between the plunger and a point of the cell which is taken as reference potential.

2. An alumina supply control process according to claim 1 wherein the point which is taken as reference potential is the negative conductor of the cell.

3. An alumina supply control process according to claims 1 or 2 wherein the plunger is electrically insulated with respect to the superstructure of the cell, to which it is fixed.

4. An alumina supply control process according to claims 1 or 2 wherein in the rest position, the plunger is set at the potential of the negative conductor of the cell.

5. An alumina supply control process according to claims 1 or 2 wherein the appearance on the plunger of the potential of the molten electrolyte, on first contact between the plunger and the electrolyte, serves as information for giving a command to raise the plunger.

6. An alumina supply control process according to claims 1 or 2 wherein if, at a given supply orifice, at the expiration of a predetermined period of time of downward movement of the plunger, there has not been detection in respect of electrical contact between the plunger and the electrolyte, automatic means gives at least one of following commands: raise the plunger, stop the supply of alumina at that point, increase the electrical power of the cell and optionally increase the rate of supply to the other alumina orifices of the cell.

7. Apparatus for carrying out the alumina supply process according to claims 1 or 2, comprising at each supply orifice a movable plunger which is electrically insulated from the superstructure of the cell and of which at least the end is electrically conducting, and a means for measuring the potential between the end of the movable plunger and a point of the cell which is taken as reference potential.

8. Apparatus according to claim 7 further comprising a resistance means for adjusting the movable plunger to a position corresponding to the electrical reference potential.

9. Apparatus according to claim 7 or claim 8 further comprising a means for producing at least one of the following commands derived from measurement of the potential of the plunger: (a) raising the plunger; (b) stopping the supply of alumina to an orifice; (c) increasing the supply of alumina to the other orifices; (d) increasing the electrical power supplied to the cell; and (e) maintaining the rate of supply of alumina.

* * * * *